US005587549A

United States Patent [19]

Clouse

[11] Patent Number: 5,587,549

[45] Date of Patent: Dec. 24, 1996

[54] ANGULAR PORTING SYSTEM AND SHOTGUN BARREL EQUIPPED THEREWITH

[75] Inventor: John D. Clouse, Batesville, Ark.

[73] Assignee: Jana, Inc., Batesville, Ark.

[21] Appl. No.: 497,771

[22] Filed: Jul. 3, 1995

[51] Int. Cl.[6] ..... F41A 21/36

[52] U.S. Cl. ..... 89/14.3

[58] Field of Search ..... 89/14.3, 14.05; 42/79, 1.06

[56] References Cited

U.S. PATENT DOCUMENTS

| | | | |
|---|---|---|---|
| 785,973 | 3/1905 | McClean | 89/14.3 |
| 2,662,326 | 12/1953 | Powell | 89/14.3 |
| 3,769,731 | 11/1973 | Pachmayr et al. | 42/79 |
| 4,207,799 | 6/1980 | Tocco | 89/14.3 |
| 4,392,413 | 7/1983 | Gwinn, Jr. | 89/14.3 |

FOREIGN PATENT DOCUMENTS

| | | | |
|---|---|---|---|
| 292633 | 6/1928 | United Kingdom | 89/14.3 |

OTHER PUBLICATIONS

Webster, Webster's New International Dictionary, Jun. 22, 1950, p. 1680.

Gun World, Cutting The Climb, May 1974, p. 35.

*Primary Examiner*—Stephen M. Johnson

*Attorney, Agent, or Firm*—Stephen D. Carver; Trent C. Keisling

[57] ABSTRACT

A barrel porting system for firearms, preferably shotguns, comprises a pair of rows of spaced apart ventilating orifices. The inclined, oblong porting orifices have radiused ends. They extend through the barrel to vent exhaust gases exteriorly. The porting orifices are defined in the barrel with an EDM machine adjacent the muzzle for ventilating hot gases to effectuate muzzle control. Preferably the orifices are angularly oriented such that each orifice axis forms an acute angle with respect to the longitudinal axis of the barrel. Preferably the latter angle is between 40 and 50 degrees. The preferred system orients the orifices in a pair of rows that are radially spaced apart between 50 and 70 degrees. Angular placement of the orifices vents gases both upwardly and rearwardly, so that resultant vector forces generated by escaping gases are translated into downwardly and forwardly directed components. Resultant downward force minimizes muzzle jump. By concurrently projecting gasses rearwardly, recoil is reduced by the resultant forwardly aimed force. As a result, shooting accuracy is substantially enhanced.

2 Claims, 3 Drawing Sheets

ANGULAR PORTING SYSTEM AND SHOTGUN BARREL EQUIPPED THEREWITH

BACKGROUND OF THE INVENTION

1. Field of the Invention

The present invention relates generally to muzzle control systems for firearm barrels. More particularly, my invention is directed to a angle porting system for shotgun barrels that greatly enhances muzzle stability.

2. Description of the Prior Art

In the prior art, it is known to provide different forms of porting for shotgun or firearm barrels. Such ports vent exit gasses during firing. The gasses are vented upwardly, to form a neutralizing force to stabilize the muzzle in response to shooting. Placement and configuration of the ports is critical. Because of the neutralizing forces generated by the escaping gases through the ports, the firearm is rendered more stable. In other words, the muzzle will not "jump" each time the firearm is discharged.

With proper porting accuracy increases. Competitive shooters can realize better scores and even amateurs can shoot better-at whatever that are aiming at. A variety of different geometries have been proposed for shotgun porting. For example, in U.S. Pat. No. 5,243,895, issued Sep. 14, 1993, the vents are arranged in rows on opposite sides of the shotgun barrel. Each of the vents is shaped like a miniature trapezoid. Other prior art venting approaches exist as well. For example, it is known in the prior art to provide round vents and to space them apart on opposite sides of the muzzle or barrel in a pair or rows.

However, sharply defined port geometries can lead to muzzle breakage and deformation. In my experience, ports must include only gently configured edges, so the critical barrel metal is not weakened or unnecessarily stressed. While simple round ports avoid unwanted sharp corners that can induce fatigue, their shape tends to direct the escaping gases improperly for maximum porting benefits. A porting system that directs exhaust gases both upwardly and forwardly is necessary to produce translation forces urging the muzzle downwardly to avoid muzzle jump and forwardly to reduce recoil.

SUMMARY OF THE INVENTION

I have developed a new porting system and a barrel equipped with the system for firearms, preferably shotguns, that reduces both muzzle jump and recoil. Through my system, the benefits of improved accuracy are readily experienced by both amateur and expert shooters. The system is ideal, for example, for target shooters and bird hunters.

Preferably a pair of radially spaced apart rows of porting orifices are defined in the barrel with an EDM machine. The rows are radially spaced apart from one another, and are located at opposite sides of the barrel ventilated rib. Each orifice is preferably oblong in shape and oriented at an inclination. The inclined, oblong orifices are generally in the form of small ovals, and have radiused ends. They extend through the barrel to vent exhaust gases exteriorly.

Because of their angular orientation, gases are vented upwardly and slightly rearwardly. The angular placement of the venting orifices translates the forces generated by escaping gases into downwardly and forwardly directed components. The resultant downward force prevents muzzle jump. By concurrently projecting gasses rearwardly, recoil is reduced by the resultant forwardly directed force.

Thus an important object of my invention is to provide an improved firearm porting system.

Another basic object of my invention is to reduce both muzzle jump and recoil.

Another object is to provide a shotgun porting system of the character described that increases firearm accuracy.

A similar object is to provide a porting system of the character described that avoids the tendency to stress or weaken metallic parts.

In other words, a related object is to avoid damaging the firearm barrel when installing porting.

Another important object is to provide a maximally accurate shotgun barrel.

A related object is to provide a system for porting firearm barrels that does not weaken the metal.

Another object is to provide a shotgun barrel equipped with the unique porting system herein described.

It is also an important object to provide a porting system that does not induce stress cracks in the barrel.

These and other objects and advantages of the present invention, along with features of novelty appurtenant thereto, will appear or become apparent in the course of the following descriptive sections.

BRIEF DESCRIPTION OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION

Figure 1:
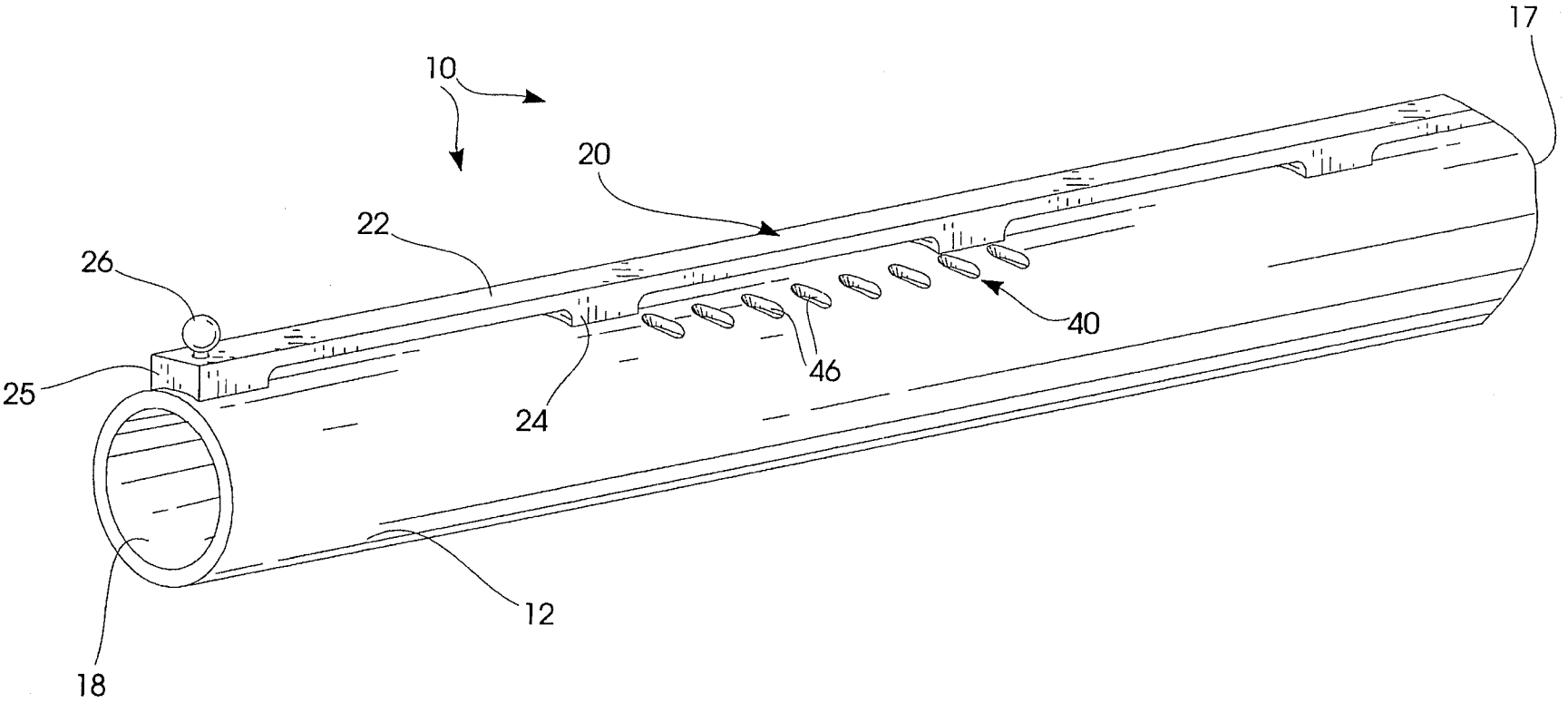
FIG. 1 is a fragmentary isometric view of a shotgun barrel equipped with my preferred angular porting system.
Figure 2:
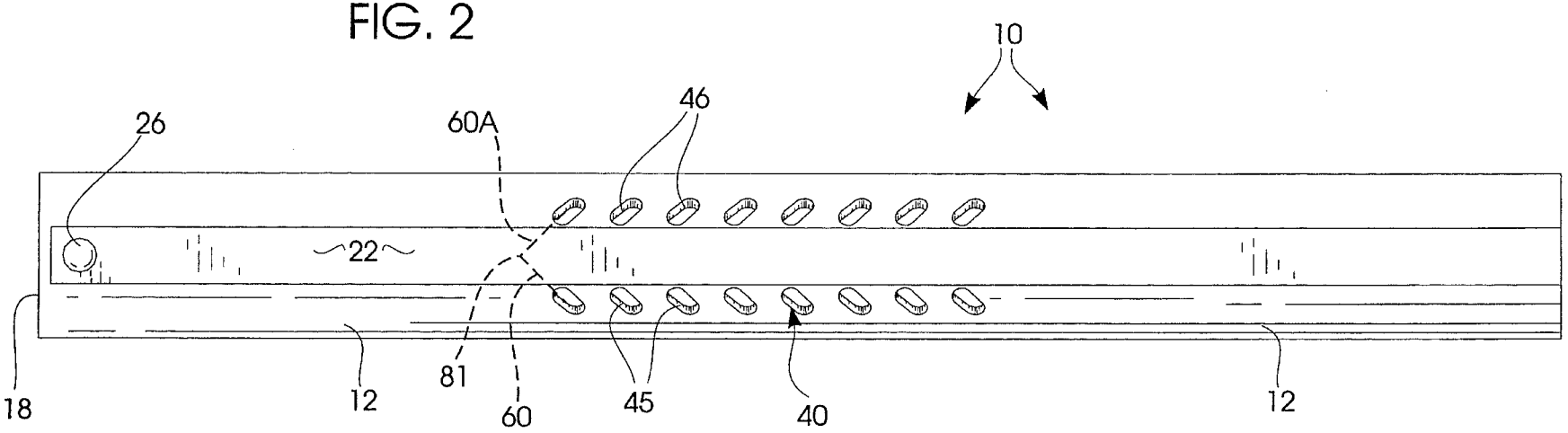
FIG. 2 is a top plan view of the barrel of FIG. 1.
Figure 3:
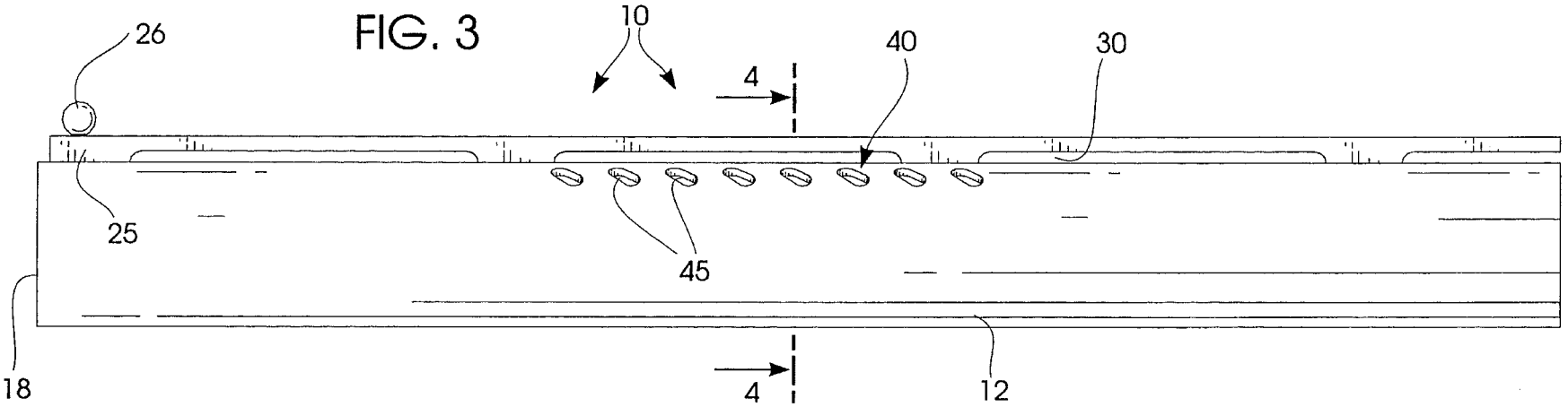
FIG. 3 is a side elevational view of the barrel of FIGS. 1–2.

With initial reference now directed to FIGS. 1–3 of the appended drawings, a shotgun barrel constructed in accordance with the teachings of this invention has been generally designated by the reference numeral 10. Barrel 10 includes an elongated, rigid tube 12 having a breech 17 that extends to a muzzle 18. An elongated, ventilated rib 20 comprises a generally rectangular section 22 extending between rises 24 that mount the rib to the shotgun barrel 12. The rib forward end 25 supports an upwardly projecting bead 26 forming the gun sighting system. Individual ribs are defined between each of the rises 24. Ventilation spaces 30 cool the barrel conventionally.

Importantly, a porting system, generally designated by the reference numeral 40, is defined in the barrel for muzzle control during firing. Due to the construction of the porting system to be hereinafter described, the increased muzzle control aids shooting accuracy and reduces recoil effects.

Preferably, the muzzle control system includes a plurality of specially placed, inclined orifices 45, 46. These oblong orifices are generally in the form of small ovals, and extend through the barrel from the outer surface 47 to the inner surface 48. As best viewed in FIG. 6, the thickness of the shotgun barrel is defined between arrows 57. A longitudinal axis 50 extends the length of the barrel. A hypothetical plane 52 (FIG. 4) is coincident with the axis 50 and divides the barrel into equal halves. A vertical hypothetical plane 54 is coincident with the longitudinal axis 50, and perpendicular to hypothetical plane 52.

Each porting orifice 45, 46 resembles an ellipse or oval and is generally oblong in shape with radiused ends. The orifices are preferably disposed in two rows, so that orifices 45 form a first row and orifices 46 form a second row. Due to the angular construction to be hereinafter described, the porting system demonstrates enhanced barrel stabilizing characteristics.

Figure 5:
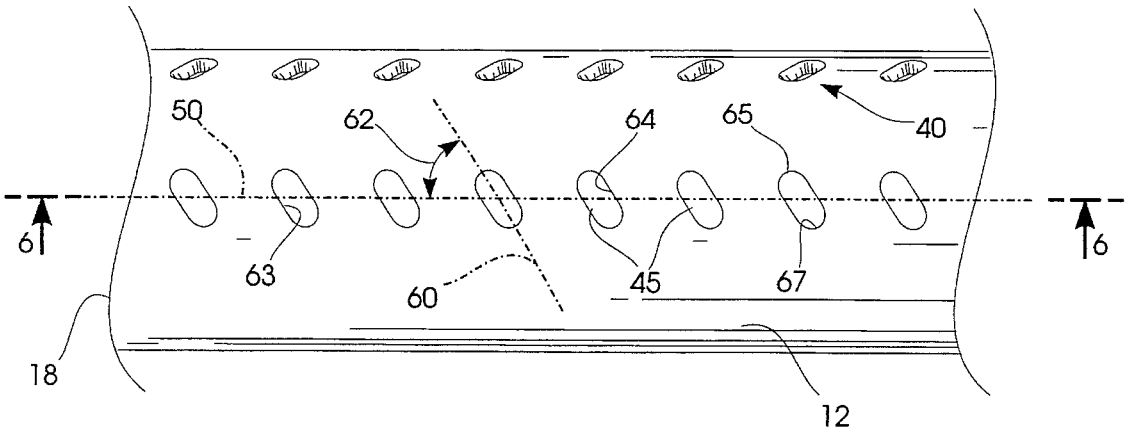
FIG. 5 is an enlarged side elevational view taken generally from the position indicated by lines 5—5 of FIG. 4, with portions omitted for clarity; and, FIG. 6 is a fragmentary sectional view taken generally along lines 6—6 of FIG. 5, with portions omitted for clarity.

As best seen in FIG. 5, each orifice has an elongated axis 60. The axis of each of the "tilted" orifices forms an angle 62 with respect to the longitudinal axis 50 of the apparatus. Preferably, this angle 62 is between 40 and 50 degrees, and ideally, in the best mode it is 45 degrees. The acute angle 62 (FIG. 5) faces the muzzle end of the barrel.

Figure 6:
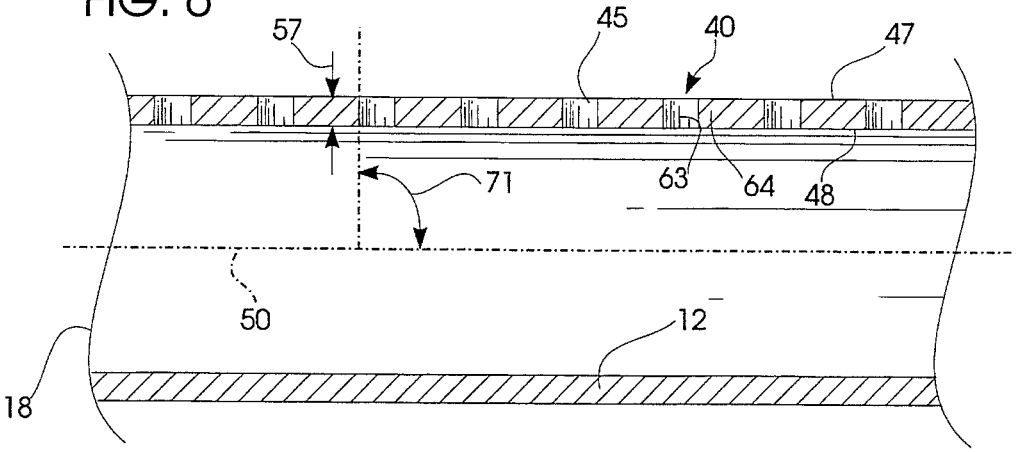

As best seen in FIG. 6, the thickness of each orifice corresponds to the thickness of the barrel designated generally between reference arrows 57. Each orifice includes generally parallel, spaced apart side walls 63 and 64 that are spaced apart from one another. These walls are generally parallel, and form a right angle 71 with the longitudinal axis 50.

Figure 4:
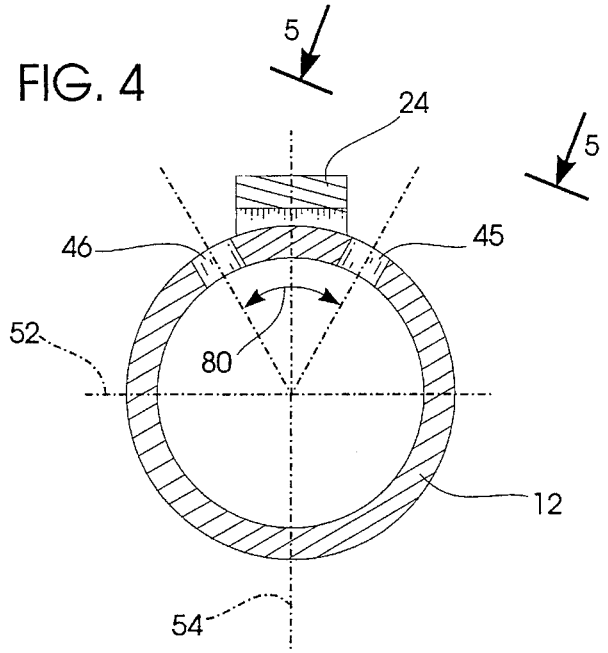
FIG. 4 is an enlarged sectional view taken generally along lines of 4—4 of FIG. 3.

With combined reference directed now to FIGS. 2–5, the porting orifices 45 and 46 are preferably arranged into two separate linear rows on opposite sides of the ventilated rib. As best seen in FIG. 4, the rows are radially spaced apart, as indicated by reference numeral 80. Preferably, the rows are spaced apart at an acute angle of approximately 50 to 70 degrees. In the best mode, the angle 80 (FIG. 4) is 60 degrees. Thus, as in FIGS. 2 and 4, each row of porting orifices appears on opposite sides of the ventilated rib, near the top of the shotgun barrel. In this manner, forces generated by escaping gases are employed to neutralize those forces that otherwise cause muzzle jump and painful recoil.

Turning to FIG. 2, the orientation of porting orifices 45, 46 is inclined to direct forces from exhaust gases properly. The upper radiused end 65 of each orifice is highest on the barrel and is aimed towards muzzle 18. The lower radiused end 67 of each orifice projects towards the breech. Stated another way, in the preferred orientation, the axis 60 and axis 60A intersect each other, forming a hypothetical arrowhead 81 that points towards muzzle 18 (FIG. 2).

In the best mode each orifice 45, 46 is generally oblong in shape. An EDM process is employed to form the orifices. For the 12-gauge shotgun barrel illustrated, each orifice measures 0.100 inches in width and 0.200 inches in length. Each orifice has a 0.050 inch radius at each end and an area of approximately 0.15 square inches. The orifices are equally spaced apart 0.300 inches between centers, i.e., it is preferred to space the orifices apart a distance equal to their width plus their length. In the best mode, each orifice has an area of 0.0178 square inches. Preferably there are eight venting orifices per row, resulting in a total of sixteen orifices per barrel, with a total area of 0.285 square inches. The total area of the combined venting orifices is thus approximately 65 percent of the area of the barrel bore (i.e., a 12-gauge shotgun barrel has an approximately three quarter inch internal diameter bore.)

With this construction, approximately seventy percent of the propelling gasses are vented through the porting before the load or projectile exits the barrel. This significantly reduces muzzle jump and felt recoil. The angled orientation of the venting orifices resolves the vector forces generated by the escaping gases. Exhaust gasses are directed upwardly, creating an opposing, downwardly directed force that resists muzzle jump. The approximately 45 degree orifice inclination also projects the gasses slightly rearwardly, which reduces recoil. The shape of the orifice has no sharp corners thereby eliminating stress cracks from having a likely place to start.

From the foregoing, it will be seen that this invention is one well adapted to obtain all the ends and objects herein set forth, together with other advantages which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A ported shotgun barrel comprising:

an elongated tubular barrel having a top and a bottom with a longitudinal axis extending substantially from a breech to a muzzle end;

two rows of regularly spaced apart oblong porting orifices defined in said barrel and extending toward said breech from adjacent said muzzle end, said rows radially spaced apart from one another along said top, and wherein each of said oblong porting orifices has an axis forming an acute angle of approximately forty-five degrees with respect to said longitudinal axis, so that forces generated by escaping gases are translated into a downwardly aimed component resisting muzzle jump and a forwardly aimed component resisting recoil;

wherein said axis of each oblong porting orifice in the first of said two rows angularly intersects said axis of the corresponding oblong porting orifice in the second of said two rows to form a hypothetical arrow that points towards said muzzle end; and, wherein the combined area of each of the porting orifices is approximately seventy percent of the interior cross-sectional area of the shotgun barrel.

2. A ported shotgun barrel comprising:

an elongated tubular barrel having a top and a bottom with a longitudinal axis extending substantially from a breech to a muzzle end;

two rows of regularly spaced apart oblong porting orifices defined in said barrel and extending toward said breech from adjacent said muzzle end, said rows radially spaced apart from one another along said top, and wherein each of said oblong porting orifices has an axis forming an acute angle of approximately forty-five degrees with respect to said longitudinal axis, so that forces generated by escaping gases are translated into a downwardly aimed component resisting muzzle jump and a forwardly aimed component resisting recoil;

wherein said axis of each oblong porting orifice in the first of said two rows angularly intersects said axis of the corresponding oblong porting orifice in the second of said two rows to form a hypothetical arrow that points towards said muzzle end;

wherein the combined area of each of the porting orifices is approximately seventy percent of the interior cross-sectional area of the shotgun barrel; and, wherein the spacing between adjacent porting orifices is approximately equal to orifice length plus orifice width.

* * * * *